US010251802B2

(12) United States Patent
Triplett et al.

(10) Patent No.: US 10,251,802 B2
(45) Date of Patent: Apr. 9, 2019

(54) PERSONAL VIBRATING PLATFORM

(71) Applicant: LifetimeVibe, LLC, Orem, UT (US)

(72) Inventors: Tyson Triplett, Provo, UT (US); Vicki Honey, Orem, UT (US)

(73) Assignee: LIFETIME VIBE, LLC, Orem, UT (US)

( * ) Notice: Subject to any disclaimer, the term of this patent is extended or adjusted under 35 U.S.C. 154(b) by 955 days.

(21) Appl. No.: 14/698,614

(22) Filed: Apr. 28, 2015

(65) Prior Publication Data

US 2015/0305957 A1 Oct. 29, 2015

Related U.S. Application Data

(60) Provisional application No. 61/985,251, filed on Apr. 28, 2014.

(51) Int. Cl.
*A61H 1/00* (2006.01)
*A61H 23/00* (2006.01)

(52) U.S. Cl.
CPC ..... *A61H 1/005* (2013.01); *A61H 1/003* (2013.01); *A61H 23/004* (2013.01); *A61H 2201/0165* (2013.01); *A61H 2201/50* (2013.01); *A61H 2201/5046* (2013.01)

(58) Field of Classification Search
CPC ..... A61H 1/00–1/005; A61H 23/00; A61H 23/02; A61H 23/0254
See application file for complete search history.

(56) References Cited

U.S. PATENT DOCUMENTS

2004/0068211 A1* 4/2004 Leivseth ..... A61H 1/005 601/49
2008/0300520 A1* 12/2008 Shin ..... A61H 1/003 601/49

* cited by examiner

*Primary Examiner* — Rachel T Sippel
(74) *Attorney, Agent, or Firm* — Kunzler, PC; Bruce R. Needham

(57) ABSTRACT

An apparatus for vibration of a person via a vibrating platform. The apparatus includes a support structure that has a fulcrum and a plurality of vibration isolators, a platform that has a central portion and lateral portions, a power assembly coupled to the platform to operably oscillate the platform about the fulcrum, and a base shell that extends around one or more sides of the platform. The central portion of the platform is pivotally coupled to and operably oscillates about the fulcrum of the support structure so that oscillation about the fulcrum causes the lateral portions to alternately rise and fall in a substantially vertical direction. Further, the base shell is mounted to the support structure free-from connectors other than the vibration isolators.

19 Claims, 8 Drawing Sheets

PERSONAL VIBRATING PLATFORM

CROSS-REFERENCE TO RELATED APPLICATION

This application claims the benefit of U.S. Provisional Patent Application No. 61/985,251, filed Apr. 28, 2014, which is incorporated herein by reference.

FIELD

The subject matter of the present disclosure relates generally to vibration systems. More specifically, this application relates to a whole-body vibration apparatus

BACKGROUND

Whole-body vibration systems can provide various health and beauty benefits. For example, whole-body vibration systems can be used to prevent muscle deterioration and alleviate the following symptoms: arthritic pain, poor-balance, constipation, cystic fibrosis, diabetes symptoms, dizziness, fatigue, fibromyalgia issues, hip pain, incontinence, insomnia, knee pain, lower back pain, lymphatic system complications, poor mobility, multiple sclerosis issues, neck pain, neuropathy, osteoporosis, plantar fasciitis, poor circulation, stress, and varicose veins, among others.

However, conventional whole-body vibration systems often have various shortcomings. For example, conventional whole-body vibration systems generally lack sufficient stability because the vibrating platform is positioned relatively too far off the ground, thus raising the center of gravity and making the entire system more likely to rock back and forth or to tip-over. Further, conventional whole-body vibration systems often fail to include sufficient vibration dampers, thus allowing vibrations to undesirably transfer to the ground and/or into user handholds, thus decreasing the overall stability of the system and/or decreasing the user's comfort. Further, conventional whole-body systems often are not sufficiently durable to withstand the repeated, oscillating vibrations.

SUMMARY

From the foregoing discussion, it should be apparent that a need exists for a whole-body vibration apparatus that overcomes the limitations of conventional vibration systems. Beneficially, such an apparatus would improve the ease, efficiency, and effectiveness of whole-body vibration systems.

The subject matter of the present application has been developed in response to the present state of the art, and in particular, in response to the problems and needs in the art that have not yet been fully solved by currently available vibration systems. Accordingly, the present disclosure has been developed to provide a whole-body vibration apparatus that overcome many or all of the above-discussed shortcomings in the art.

According to one embodiment, disclosed herein is an apparatus for vibration of a person via a vibrating platform. The apparatus includes a support structure that has a fulcrum and a plurality of vibration isolators, a platform that has a central portion and lateral portions, a power assembly coupled to the platform to operably oscillate the platform about the fulcrum, and a base shell that extends around one or more sides of the platform. The central portion of the platform is pivotally coupled to and operably oscillates about the fulcrum of the support structure so that oscillation about the fulcrum causes the lateral portions to alternately rise and fall in a substantially vertical direction. Further, the base shell is mounted to the support structure free from connectors other than the vibration isolators.

In one implementation, the vibration isolators are first vibration isolators and the apparatus further comprises second vibration isolators positioned between the support structure and a surface supporting the apparatus that isolate vibrations from the support structure to the surface supporting the apparatus. In such an implementation, the second vibration isolators may support the support structure above the surface supporting the apparatus in addition to providing vibration isolation.

In another implementation, the apparatus further includes a riser coupled to the base shell. The riser may have handles that are located at a height convenient for a user to hold while the user is positioned on the platform during vibration. In such an implementation, one or more of the base shell and the riser may contact a surface supporting the apparatus at one or more surface contact points, with the surface contact points further stabilizing the base shell and the riser from vibrations of the platform and the support structure.

In yet another implementation, the vibration isolators have motion dampers. In a further implementation, the base shell is mounted to the support structure exclusively via the vibration isolators. The power assembly may have a displacement member that coupled to the platform to operably oscillate the platform about the fulcrum and the displacement member may extend in a displacement direction that is substantially perpendicular to the vertical direction. In such an implementation, the platform may include an arm that extends below the central portion of the platform, the arm having multiple connection points along a length of the arm to which the displacement member can be coupled so that oscillation magnitude of the platform about the fulcrum is dependent on which connection point the displacement member is coupled to.

The power assembly in such an implementation may further include a motor mounted to the support structure, a driveshaft rotated by the motor, and two bearings mounted to the support structure for supporting the driveshaft. The driveshaft extends in a first direction and the displacement member is rotatably and eccentrically coupled to the driveshaft, with the first direction being substantially perpendicular to the displacement direction. The two bearings may be positioned on opposite sides of the displacement member. The displacement member and at least one of the two bearings may be mounted to the support structure in a position beyond a horizontal footprint of the platform.

Also disclosed herein is another embodiment of an apparatus for vibration of a person via a vibrating platform. The apparatus includes a support structure having a fulcrum and a plurality of vibration isolators, a platform having a central portion and lateral portions, a power assembly, and a base shell extending around sides of the platform. The central portion of the platform is pivotally coupled to and operably oscillates about the fulcrum of the support structure so that oscillation about the fulcrum causes the lateral portions to alternately rise and fall in a substantially vertical direction. The power assembly includes a motor mounted to the support structure, a driveshaft rotated by the motor so that the driveshaft extends in a first direction, and a displacement member rotatably and eccentrically coupled to the driveshaft and extending in a displacement direction, with the first direction being substantially perpendicular to the displacement direction. The base shell is mounted to the support structure free from connectors other than the vibration isolators.

In one implementation, the vibration isolators are first vibration isolators and the apparatus further includes second vibration isolators positioned between the support structure and a surface supporting the apparatus that isolate vibrations from the support structure to the surface supporting the apparatus. In one implementation, the vibration isolators are motion dampers. In another implementation, the base shell is mounted to the support structure exclusively via the vibration isolators. In yet another implementation, the power assembly further includes two bearings mounted to the support structure for supporting the driveshaft, with the two bearings being positioned on opposite sides of the displacement member. In such an implementation, the two bearings may be equally spaced from the displacement member and the driveshaft may have an eccentric section to which the displacement member is rotatably coupled.

Further disclosed herein is yet another embodiment of an apparatus for vibration of a person via a vibrating platform. The apparatus includes a support structure having a fulcrum and a plurality of vibration isolators, a platform having a central portion and lateral portions, a power assembly, and a base shell extending around sides of the platform. The central portion of the platform is pivotally coupled to and operably oscillates about the fulcrum of the support structure so that oscillation about the fulcrum causes the lateral portions to alternately rise and fall in a substantially vertical direction. The power assembly includes a motor mounted to the support structure, a driveshaft rotated by the motor so that the driveshaft extends in a first direction, a displacement member rotatably and eccentrically coupled to the driveshaft and extending in a displacement direction, with the first direction being substantially perpendicular to the displacement direction, and two bearings mounted to the support structure for supporting the driveshaft. The two bearings are positioned on opposite sides of the displacement member and the base shell is mounted to the support structure free from connectors other than the vibration isolators.

In one implementation, the two bearings are equally spaced from the displacement member. In another implementation, the driveshaft has an eccentric section to which the displacement member is rotatably coupled.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
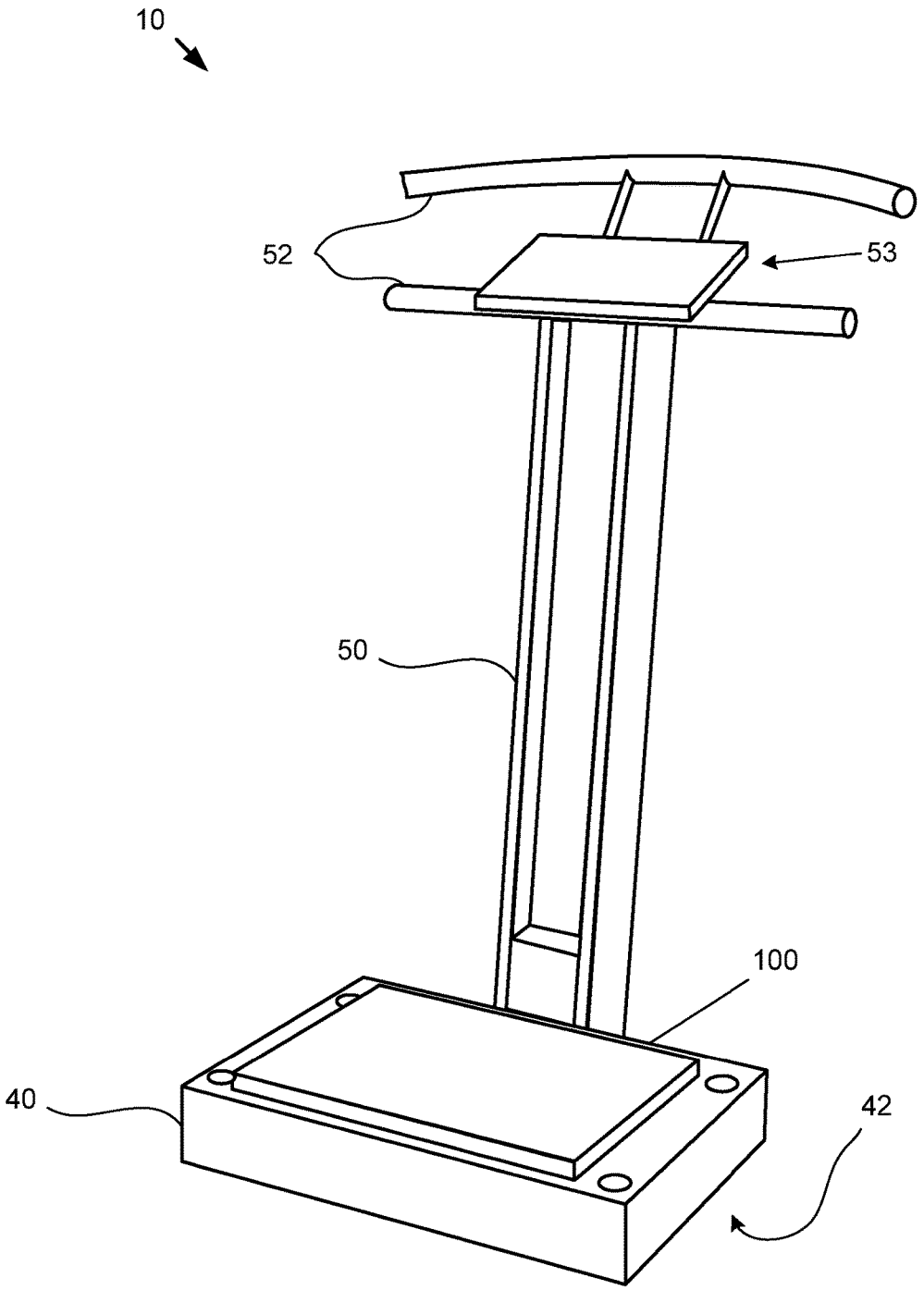
FIG. 1 is a perspective view of one embodiment of a personal vibrating apparatus.

FIG. 1 is a perspective view of one embodiment of a personal vibrating apparatus 10. As briefly described above in the Background section, whole-body vibration systems provide numerous benefits to users. The personal vibrating apparatus 10 disclosed in the present disclosure includes a vibrating platform module 100, a base shell 40, and a riser 50. The vibrating platform module 100, as described in greater detail below with reference to remaining figures, generally oscillates back and forth to impart a whole-body vibration therapy to a user. The base shell 40 extends around the vibrating platform module 100 and provides a partial housing for the components of the vibrating platform module 100 (as described below). The riser 50 is coupled to the base shell 40 and includes handles 52 and a user control interface 53. A user of the personal vibrating apparatus 10 may hold on to the handles 52 to support the user during a vibration therapy session and the user may adjust various operating parameters via the user control interface 53. For example, the user control interface 53 may include knobs, switches, touch-screens, dials, displays, and/or buttons that allow a user to control the vibration frequency, the duration of the vibration therapy, the vibration patterns, the sequence of vibration patterns, and the magnitude of vibration, among others parameters.

According to one embodiment, the base shell 40 is attached to the vibrating platform module 100 via vibration isolators (described below). In addition to the vibration isolators, the base shell 40 and/or riser 50 may also include various contact points or contact surfaces that directly engage a surface (i.e., the ground) upon which the apparatus is supported. In other words, the base shell 40 and riser 50 may engage the ground via one or both of the following configurations: indirectly via the vibrating platform module 100 and directly via contact surfaces 42.

Figure 2:
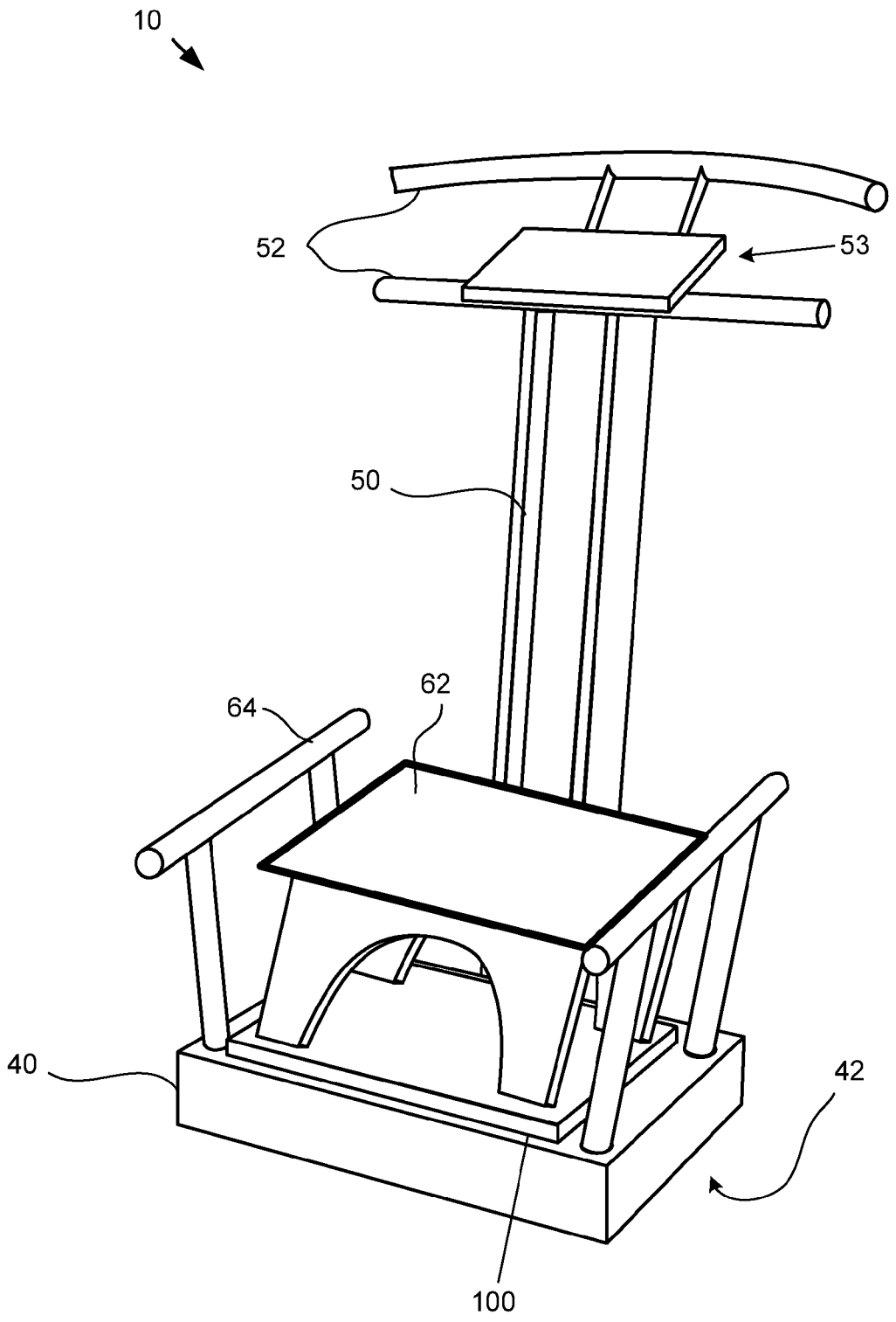
FIG. 2 is a perspective view of another embodiment of a personal vibrating apparatus.

FIG. 2 is a perspective view of another embodiment of a personal vibrating apparatus 10 that includes a stool 62 and hand rails 64. The personal vibrating apparatus 10 oscillates to impart mechanical vibrations to the body of a user. While in one embodiment a user may stand on the vibrating platform module 100, in another embodiment the user may sit on a stool 62 or other personal support structure to experience the vibration therapy. Further, the stool 62 may be used to elevate and isolate certain parts of the body, thus allowing a user to modify the vibration therapy according to his/her preferences. The hand rails 64 may be attached to the base shell 40, as depicted, or may be attached to the vibrating platform module 100. In another embodiment, the personal vibrating apparatus 10 may include other accessories to further allow a user to customize his/her vibration therapy.

Figure 3:
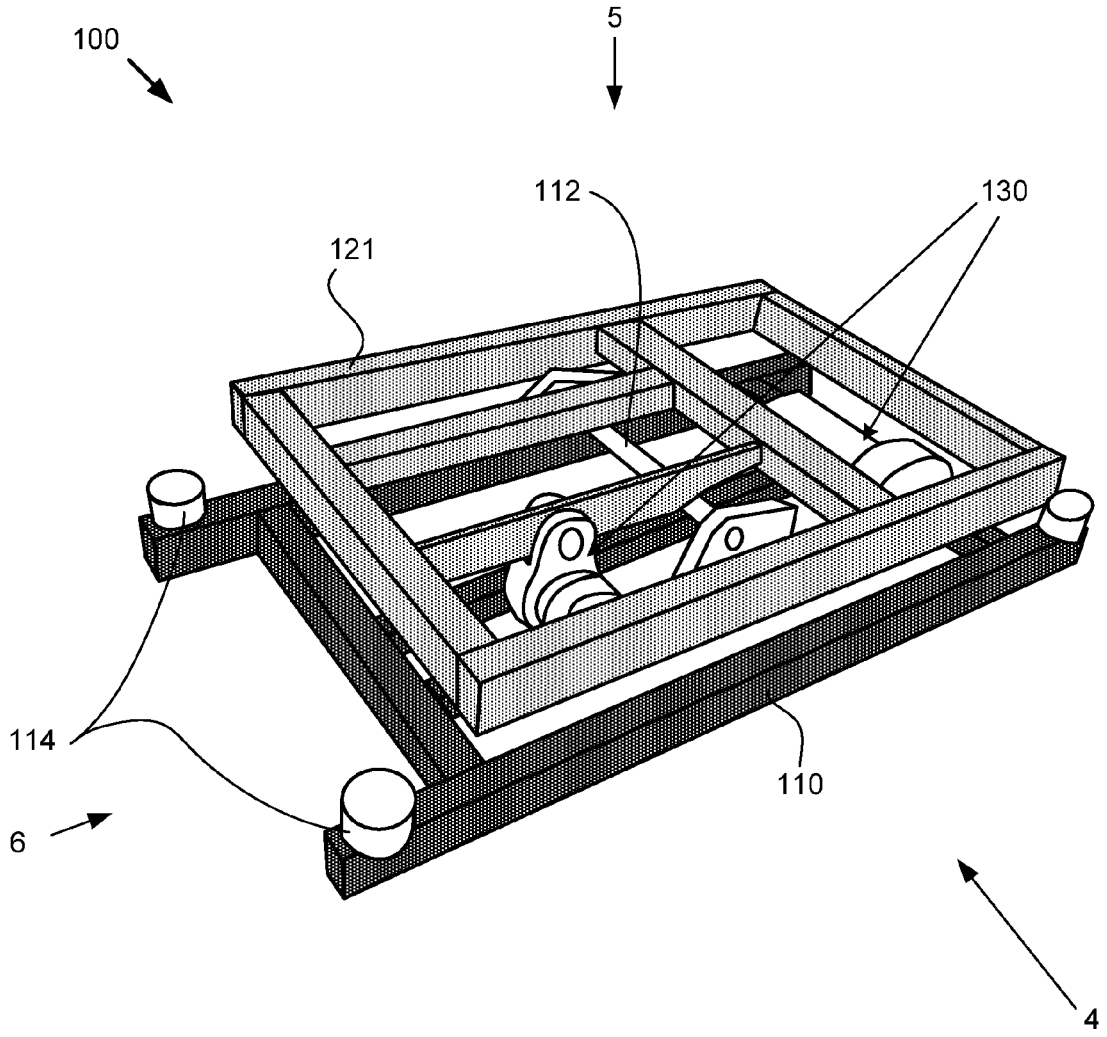
FIG. 3 is a perspective view of one embodiment of a vibrating platform apparatus.

FIG. 3 is a perspective view of one embodiment of a vibrating platform module 100. The vibrating platform module 100 includes a support structure 110, a platform framework 121, and a power assembly 130. Generally, the support structure 110 engages the surface upon which the vibrating platform module 100 is supported and provides framework to which the other components are mounted. The platform surface, upon which users position themselves, is not depicted in FIG. 3 in order to clearly illustrate the components that are housed below the platform (according to one embodiment). In one embodiment, the platform and the platform framework 121 are detachably coupleable to allow a user to remove the platform to inspect and/or repair the components of the vibrating platform module 100 without having to completely disassemble the vibrating platform module 100. In another embodiment, the platform may be a single, unitary structure instead of having a platform framework 121 that is separable from the platform surface. In the depicted embodiment, the platform framework 121, to which the platform may be attached, is shown pivotally attached to a fulcrum 112 of the support structure.

In one embodiment, the fulcrum 112 is a rotating shaft that is substantially permanently attached (e.g., via welding) to the platform framework 121. Hereinafter, substantially permanently attached may include other forms of attachment that are permanently attached, such as welding, or other forms of attachment that are intended to be permanent or securely fixed during operation. For example, substantially permanently attached may include mechanisms such as bolts, rivets, adhesives or other bonding methods intended to be permanent or permanent during operation, but may be reversed during repair and/or maintenance. One of skill in the art will recognize other ways to substantially permanently attach items together. In such an embodiment, the fulcrum 112 may be rotatably supported by bearings (see below) on the support structure 110. In another embodiment, the fulcrum 112 is a non-rotating shaft that is substantially permanently attached to the support structure 110 and the platform framework 121 rotatably engages (i.e., pivots about) the fulcrum 112. The power assembly 130 includes the components that actuate the vibrating motion. Although described in greater detail below, the power assembly 130, according to one embodiment, may simply include a motor and an attached displacement member that imparts the vibrating, oscillatory motion to the platform framework 121. For example, the displacement member may be eccentrically and rotatably coupled to the driveshaft of a motor, thus converting rotational movement into reciprocating motion. As described in greater detail below with reference to FIG. 6, the terms "eccentric" and "eccentrically" refer to a mechanical means of coupling two members together in an offset manner, thus allowing a rotary force of one of the two members to be converted to a reciprocating force. FIG. 3 also depicts various viewpoints 4, 5, 6 from which FIGS. 4, 5, and 6, are respectively depicted.

Figure 4:
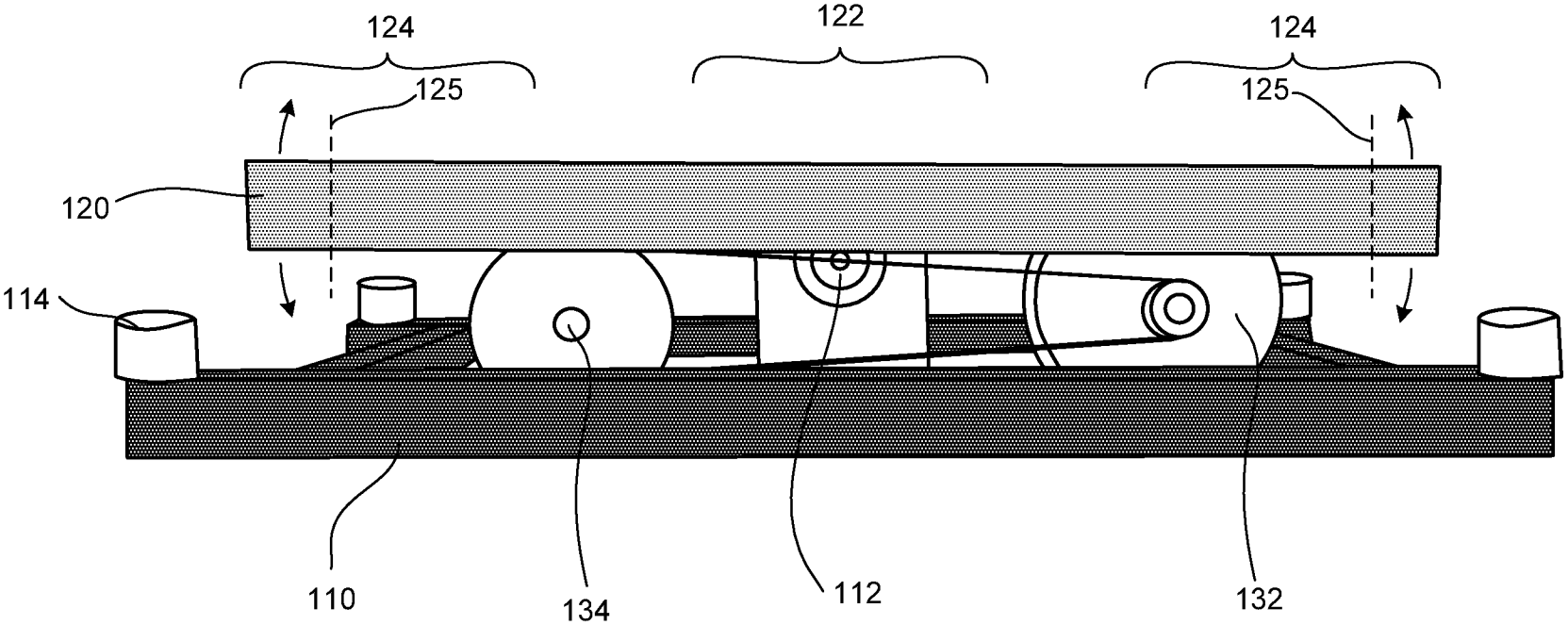
FIG. 4 is a front view of one embodiment of a vibrating platform apparatus.

FIG. 4 is a front view of one embodiment of a vibrating platform module 100. The vibrating platform module 100 includes a platform 120 (e.g., the platform framework 121 described above) pivotally connected to a fulcrum 112 of the support structure 110. The platform 120 has a central portion 122 and two lateral portions 124. The fulcrum 112 is pivotally coupled to the central portion 122 of the platform 120. In one embodiment, the fulcrum 112 is pivotally coupled exactly to the mid-line of the platform 120, thereby causing the magnitude of oscillation to be the same on both lateral portions 124 of the platform 120. In another embodiment, the fulcrum 112 may pivotally connect to the platform 120 at a location that is off-center from the mid-line, thus creating unequal oscillation magnitudes at the lateral portions 124. Thus, the central portion 122 of the platform 120 may not necessarily be the exact mid-line of the platform 120. In other words, the central portion 122 is defined as the region between the two lateral portions 124 that is pivotally supported by the fulcrum 112.

As the platform 120 oscillates about the fulcrum 112, the lateral portions 124 of the platform 120 alternately rise and fall in a substantially vertical direction 125. The terms "vertical direction" 125 and "substantially vertical direction" 125 are used herein with reference to the generally up-and-down motion of the lateral portions 124 of the platform. In other words, although during operation of the vibrating platform module 100 the lateral edges of the lateral portions 124 actually follow a curved/arcuate path, the lateral portions 124 generally reciprocate in a vertical direction 125. FIG. 4 also depicts a motor 132 and a driveshaft 134. The motor 132 may be an electrical motor that receives energy from an electrical interface (e.g., electrical cord connected to a standard electrical outlet). The driveshaft 134 may extend directly from the motor 132 or the driveshaft 134 may be operably coupled to the motor 132 via intermediate driveshafts, intermediate chain drives, intermediate belt assemblies, etc. Additionally, the motor 132 and/or driveshaft 134 may further include gearing assemblies that control the output torque of the driveshaft 134.

Figure 5:
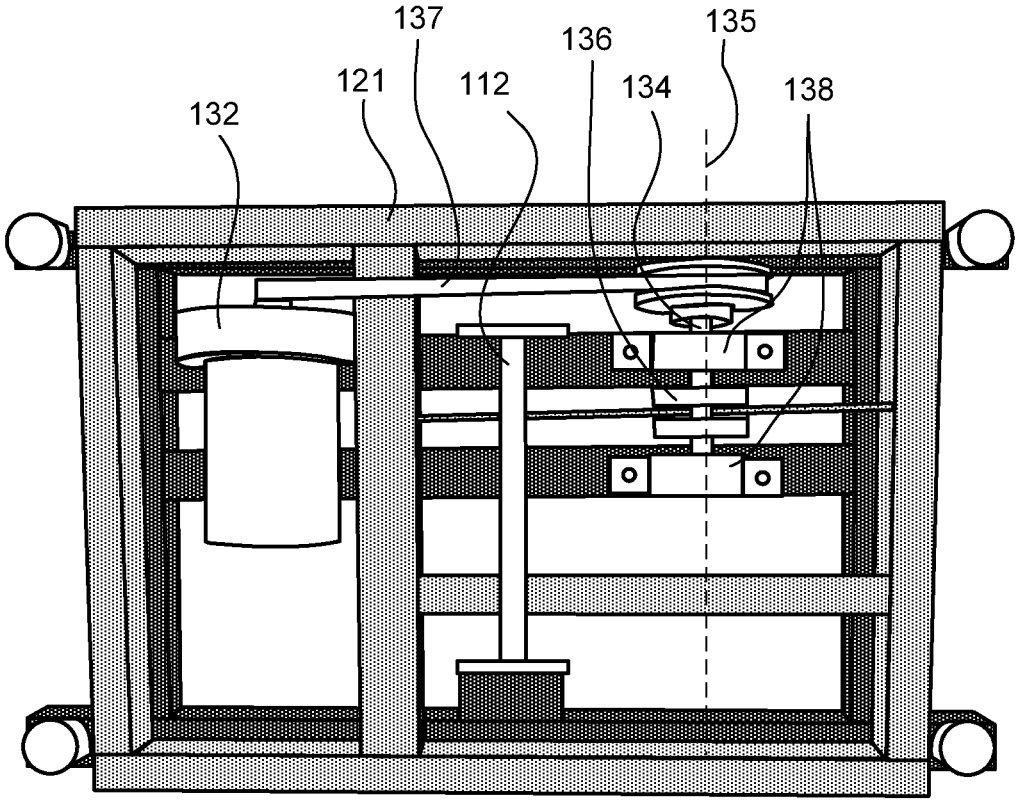
FIG. 5 is a top view of one embodiment of a vibrating platform apparatus.
Figure 6:
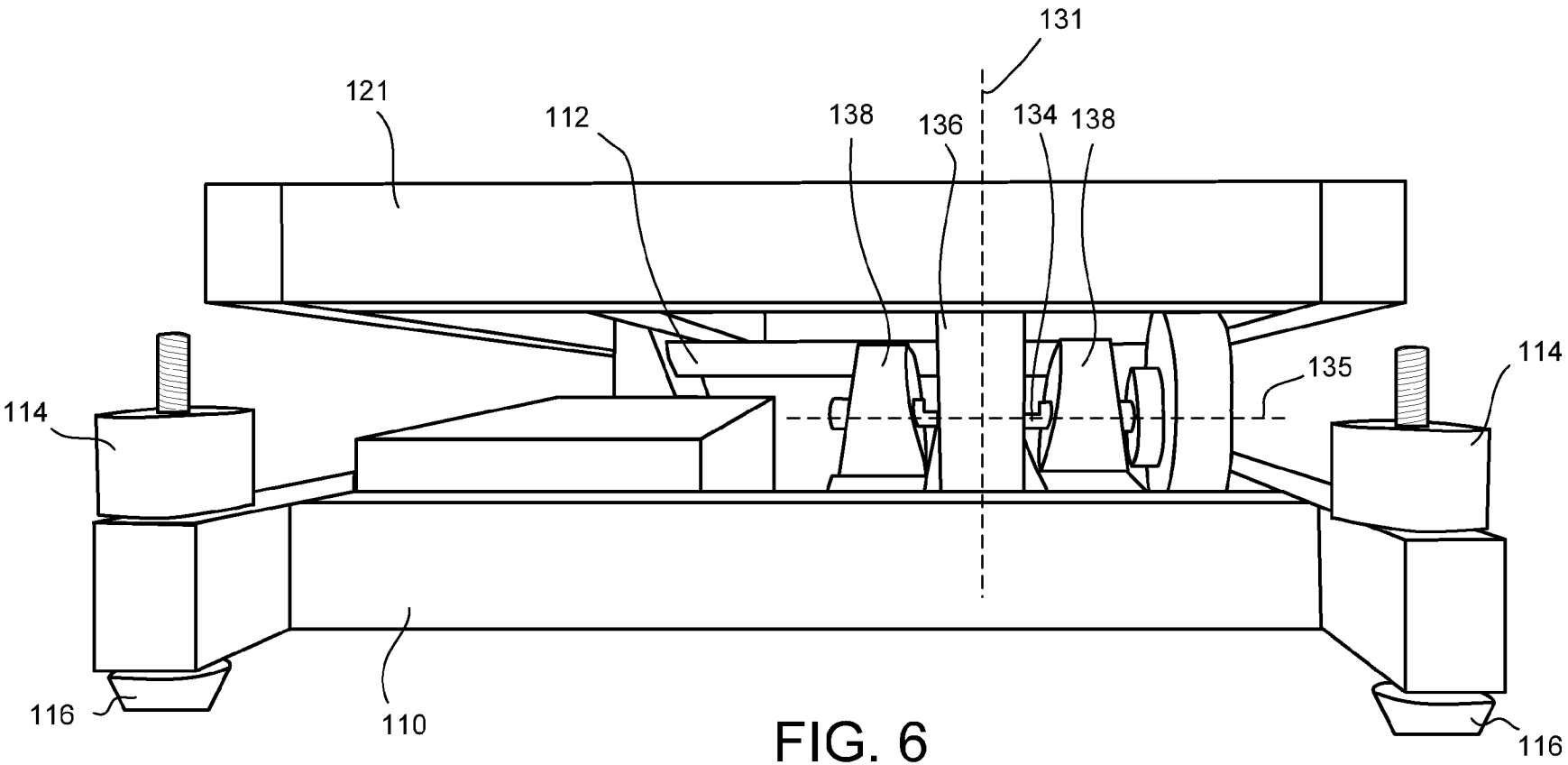
FIG. 6 is a side view of one embodiment of a vibrating platform apparatus.

FIG. 5 is a top view of one embodiment of a vibrating platform module 100. Once again, the platform framework 121 is pivotally supported by the fulcrum 112 of the support structure 110. The motor 132 is operably connected to the driveshaft 134 (e.g., via a drive belt 137) which extends in a first direction 135. In one embodiment, the first direction 135 is substantially perpendicular to the vertical direction 125 (i.e., oscillation direction) of the lateral portions 124 of the platform 120. As used herein, substantially perpendicular may include exactly perpendicular or other angles that are close to perpendicular. For example, where the vertical direction 125 is substantially vertical but varies a small amount, the first direction 135 may be horizontal or substantially horizontal where the first direction 135 may vary a little with motion of the motor 132 or as the platform 120 rises and falls. Thus the first direction 135 is generally horizontal while the vertical direction 125 is generally vertical. In one embodiment, a displacement member 136 is operably inter-coupled between the driveshaft 134 and the platform 120 or platform framework 121.

According to one embodiment (as described in greater detail below) the displacement member 136 is eccentrically coupled to the driveshaft 134 in order to convert the rotational motion of the driveshaft 134 into a reciprocating motion that oscillates the platform 120 about the fulcrum 112. The power assembly 130 may further include two bearings 138 on opposite sides of the displacement member 136 that support the driveshaft 134. Because of the eccentrical connection between the driveshaft 134 and the displacement member 136 (described in detail below), if the driveshaft 134 of the power assembly 130 were only supported by a single bearing, the load of the platform 120 would mechanically stress the single bearing. However, the vibrating platform module 100, according to one embodiment, includes at least two bearings 138, one on each side of the displacement member 136. In one embodiment, the two bearings 138 are equally spaced apart from the displacement member 136. In another embodiment, the vibrating platform module 100 may have more than two bearings. For example, the vibrating platform module 100 may have three bearings where a bearing is placed on either side of the load bearing displacement member 136 and an additional bearing near the motor 132. In another embodiment, the vibrating platform module 100 may have four bearings with two on each side of the load bearing displacement member 136. One of skill in the art will recognize other bearing configurations that may reduce wear and reduce unwanted vibrations.

FIG. 6 is a side view of one embodiment of a vibrating platform module 100. As described above, the displacement member 136 is coupled between the driveshaft 134 and the platform 120. The rotating motion of the driveshaft 134 is converted to displacement motion that oscillates the platform 120. In one implementation the displacement member 136 is eccentrically coupled to the driveshaft 134. In other words, for example, an off-center portion of the driveshaft 134 (see FIG. 6) may rotatably extend through an aperture in the displacement member 136. In such an embodiment, the rotation of the off-center portion of the driveshaft 134 imparts a linear reciprocating motion to the displacement member 136, which in turn causes the platform 120 to oscillate. In other embodiments, the driveshaft 134 and the displacement member 136 may be coupled together in a different configuration or other mechanisms may be implemented to create the reciprocating displacement motion.

The embodiment of the displacement member 136 depicted in FIG. 6 extends in a vertical displacement direction 131. The term "displacement direction" refers to the general, composite direction of the resultant displacement motion. In one embodiment, as depicted in FIG. 6, the displacement member 136 moves in a generally vertical displacement direction 131 that is substantially perpendicular to the first direction 135 of the driveshaft. However, the qualifying term "vertical" does not necessarily require the displacement member 136 to extend in a direction that is exactly parallel to the vertical direction 125 of the lateral portions 124 of the platform 120. For example, depending on the specifics of a given application, the displacement member 136 may extend in a displacement direction 131 that is generally upwards from the driveshaft 134 but that is angled so as to not be exactly perpendicular to the platform 120 or exactly perpendicular to the ground/surface upon which the vibrating platform module 100 is supported.

FIG. 6 also depicts one embodiment of the vibration isolators 114 mentioned above. In one embodiment, the base shell 40 and/or the riser 50 may be exclusively supported (i.e., exclusively connected to the ground) via the vibration isolators 114 of the support structure 110. In another embodiment, the only physical connection between the vibrating platform module 100 and the base shell 40 is via the vibration isolators 114. In such an embodiment, the vibration isolators 114 prevent or at least mitigate the propagation of vibrations to the base shell 40 and/or the riser 50. Accordingly, the apparatus 10 is comparatively more stable and vibrations are only applied to the user via the platform 120 and not indirectly via secondary vibrations from the handles 52 of the riser 50.

The vibration isolators 114 may include a body that damps the vibrations that arise from the oscillating motion of the platform 120, thus limiting the vibrations that are conveyed to the base shell 40 and/or riser 50. For example, the vibration isolators 114 may include a rubber material that absorbs the vibrations. In another embodiment, the vibration isolator 114 may include a shock-absorbing assembly or other vibration damping material. In one embodiment, the support structure 110 may have multiple, independent vibration isolators 114 (as depicted). For example, the support structure 110 may have vibration isolators 114 at each corner of the support structure 110 or may have multiple vibration isolators 114 along each side of the support structure 110. In another embodiment, the vibration isolators 114 may be connected together or may be implemented as a single, unitary damping layer disposed between the support structure 110 and the base shell 40.

The damping effect of the vibration isolators 114 may be achieved by implementing materials that have favorable compression properties (e.g., certain polymers, plastics, and rubber materials), utilizing a fluidic damping configuration (e.g., particle dampers), and/or utilizing mechanical absorbers that mechanically absorb vibrations (e.g., shock absorbers, springs, etc.). For example, the vibration isolators 114 may incorporate viscous damping, viscoelastic damping, friction damping, and impact damping. In one embodiment, the vibration isolators 114 are passive. In another embodiment, however, the vibration isolators 114 may be active and thus may be configured to respond to and dampen certain vibration conditions. For example, the damping effect of the vibration isolators 114 may be dependent on the rotations per minute of the driveshaft and/or the oscillation frequency of the platform. In another embodiment, the user may select (e.g., via the user control interface 53 of the riser 50) the properties of the vibration isolators 114, thus allowing the user to adjust the damping effect of the vibration isolators in order to choose the extent of vibration propagation from the vibrating platform module 100 to the base shell 40 and/or riser 50. For example, a user may choose to reduce the damping/isolation effect of the vibration isolators 114 in order to allow a certain degree of secondary vibrations to propagate up through the riser 50 and into the user's hands via the handles 52.

In one embodiment, the vibration isolators 114 of the vibrating platform module 100 may include a heat sink configuration that facilitates that transmission of heat away from the vibration isolators 114. Depending on the type and material of the vibration isolators 114, repeated compression/damping may produce heat. Accordingly, the vibrating platform module 100 may include heat transmission lines that draw heat away from the vibration isolators 114, thus extending the lifetime of the vibration isolators 114 and potentially improving the performance and effectiveness of the vibration isolators 114.

The support structure 110 may further include second vibration isolators 116 that engage the ground/surface upon which the vibrating platform module 100 is supported, thus damping the magnitude of vibrations transferred to the ground and thereby making the personal vibrating apparatus more stable. In another embodiment, vibration isolators may be disposed on exterior lateral sides of the support structure 110 to engage the interior lateral sides of the base shell 40. Accordingly, the vibration isolators may be constructed from a variety of materials and may be implemented in a variety of configurations, as recognized by those of ordinary skill in the art.

Figure 7A:
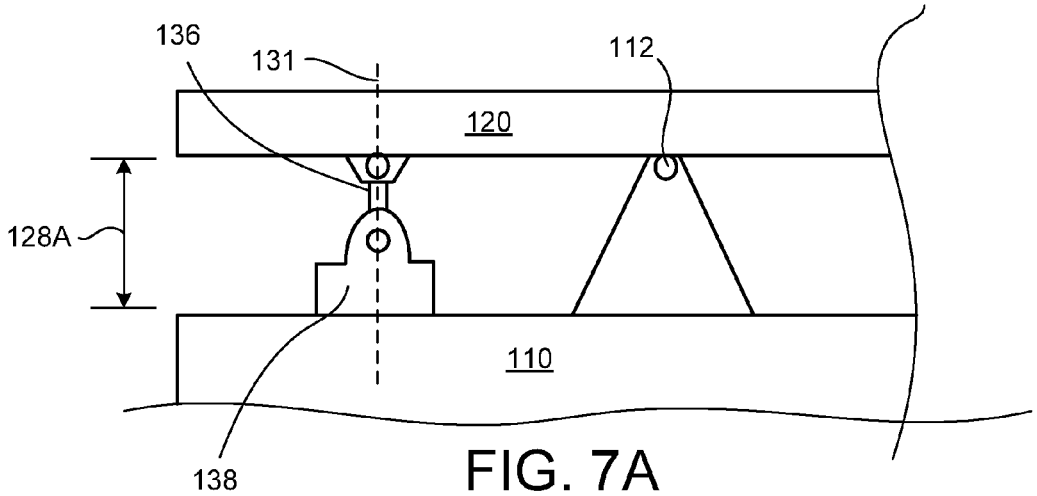
FIG. 7A is a schematic front view of one embodiment of a bearing, a displacement member extending substantially vertically, and a platform pivotally connected to a fulcrum of a support structure.

FIG. 7A is a schematic front view of one embodiment of a bearing 138, a displacement member 136 extending in a substantially vertical displacement direction 131, and a platform 120 pivotally connected to a fulcrum 112 of a support structure 110. The remaining components of the power assembly 130 (motor 132, driveshaft 134, etc) are not depicted in FIG. 7A for purposes of description clarity. As described above, the displacement member 136 may extend in a vertical displacement direction 131 and may be coupled to the bottom of the platform 120. In such an embodiment, the vertical displacement direction 131 of the reciprocating displacement member 136 alternately pushes and pulls the platform up and down, respectively, to impart the oscillatory motion to the platform 120. FIG. 7A also shows the distance 128A between the platform 120 and the support structure 110. In one embodiment, the overall stability of the vibrating platform module 100 depends on the height of the platform 120. For example, when the height of the vibrating platform module 100 is comparatively higher, the center of gravity is elevated and the stability decreases. Accordingly, in one implementation it may be desirable to position the oscillating platform 120 as close to the ground as possible to lower the center of gravity and increase stability. The overall height of the vibrating platform module 100 may be decreased by decreasing the distance 128A between the platform 120 and the support structure 110.

Figure 7B:
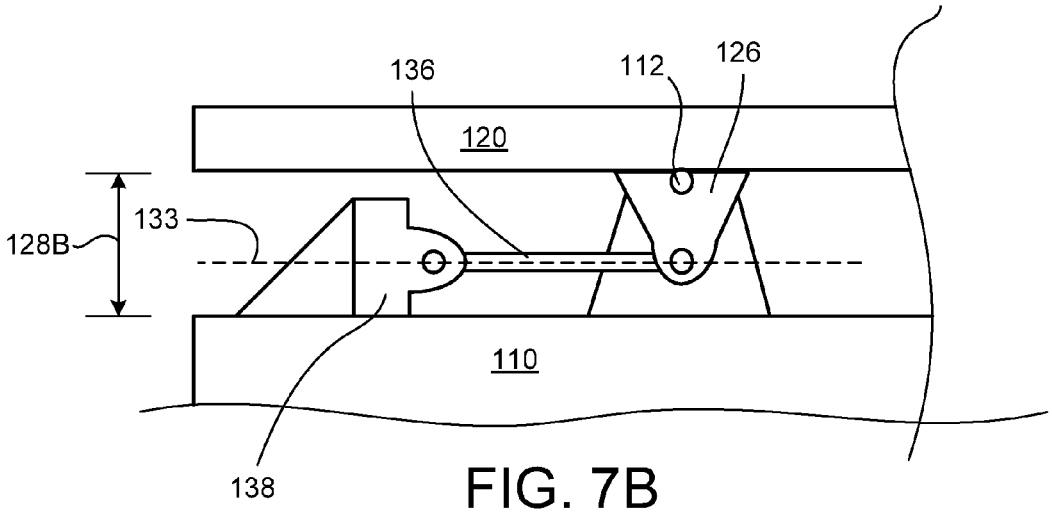
FIG. 7B is a schematic front view of another embodiment of a bearing, a displacement member extending substantially horizontally, and a platform pivotally connected to a fulcrum of a support structure.

FIG. 7B is a schematic front view of another embodiment of a bearing 138, a displacement member 136 extending in a substantially horizontal displacement direction 133, and a platform 120 pivotally connected to a fulcrum 112 of a support structure 110. Once again, the remaining components of the power assembly 130 (motor 132, driveshaft 134, etc) are not depicted in FIG. 7B for purposes of description clarity. In the depicted embodiment, the displacement member 136 extends in a substantially horizontal displacement direction 133. In such an embodiment, the platform 120 includes an arm 126 that extends down from the bottom of the platform 120 to which the displacement member 136 is coupled. As described below with reference to FIGS. 8A-8C, the displacement member 136 may not extend exactly horizontally and may be slightly angled. In other words, the qualifier "horizontal" in relation to the displacement direction does not require the displacement member 136 to extend exactly horizontally but instead generally refers to a direction that is somewhat perpendicular to the vertical oscillating motion 125 of the lateral portions 124 of the platform 120 (see FIG. 4).

In such an embodiment, the horizontal displacement direction 133 of the reciprocating displacement member 136 alternately pushes and pulls the arm 126 back and forth, thus causing the platform 120 to rock back and forth. Among other benefits, the horizontal displacement direction 133 may be advantageous in certain implementations in order to reduce the distance 128B between the platform 120 and the support structure 110, thus increasing the stability of the apparatus.

Figure 7C:
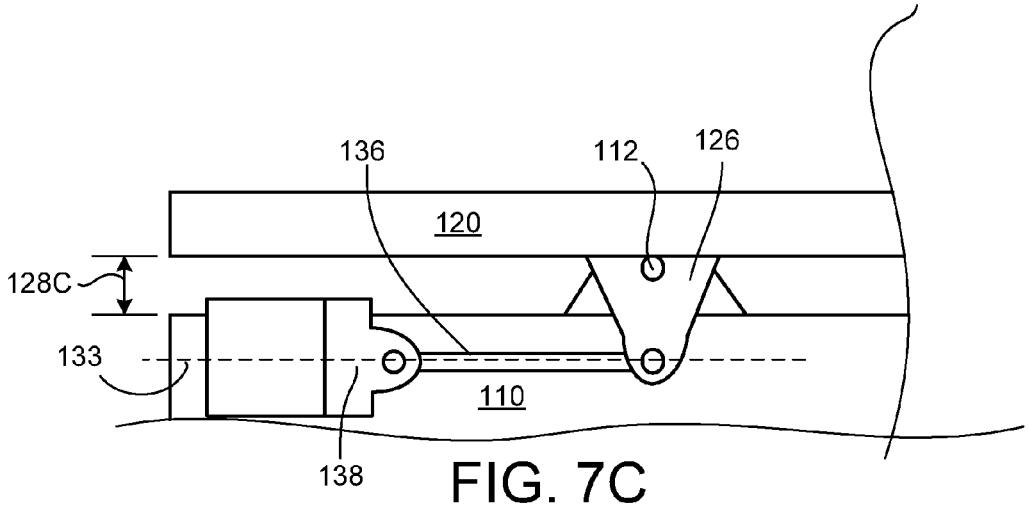
FIG. 7C is a schematic front view of another embodiment of a bearing mounted to a lateral side of a support structure, a displacement member extending substantially horizontally, and a platform pivotally connected to a fulcrum of the support structure.

FIG. 7C is a schematic front view of another embodiment of a bearing 138 mounted to a lateral side of a support structure 110, a displacement member 136 extending in a substantially horizontal direction 133, and a platform 120 pivotally connected to a fulcrum 112 of the support structure 110. In such an embodiment, the distance 128C between the platform 120 and the support structure 110 may further be decreased, thus further stabilizing the apparatus. In other words, according to one embodiment, the displacement member 136 and at least one of the two bearings 138 are mounted to the support structure 110 in a position beyond a horizontal footprint of the platform to allow the platform 120 to be positioned comparatively closer to the ground, thus lowering the center of gravity of the vibrating platform module 100.

Figure 8A:
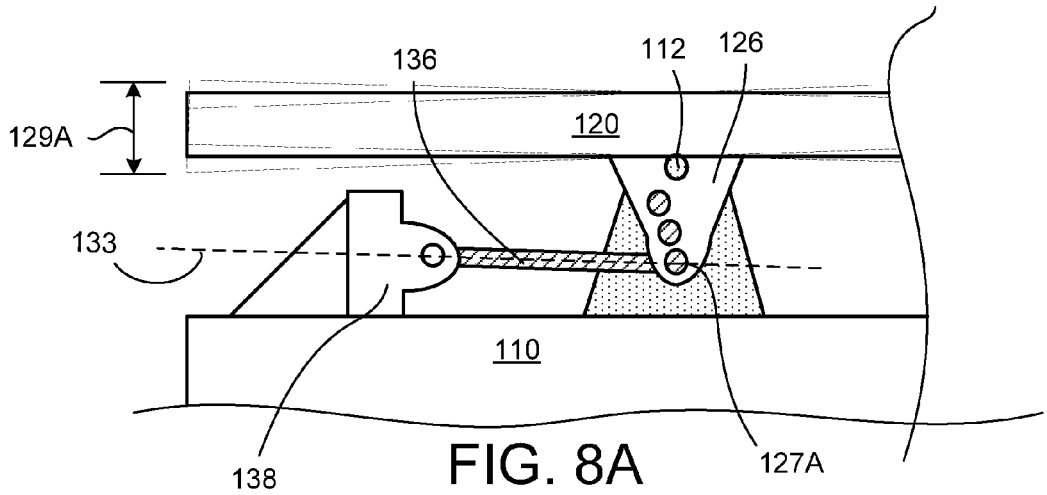
FIG. 8A is a schematic front view of one embodiment of a vibrating platform apparatus in a first oscillation magnitude configuration.
Figure 8B:
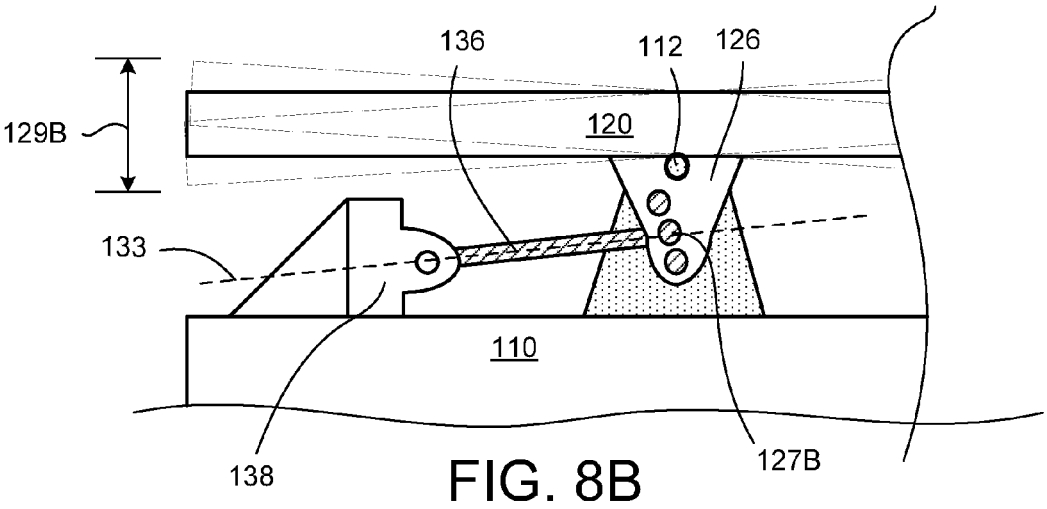
FIG. 8B is a schematic front view of another embodiment of a vibrating platform apparatus in a second oscillation magnitude configuration.
Figure 8C:
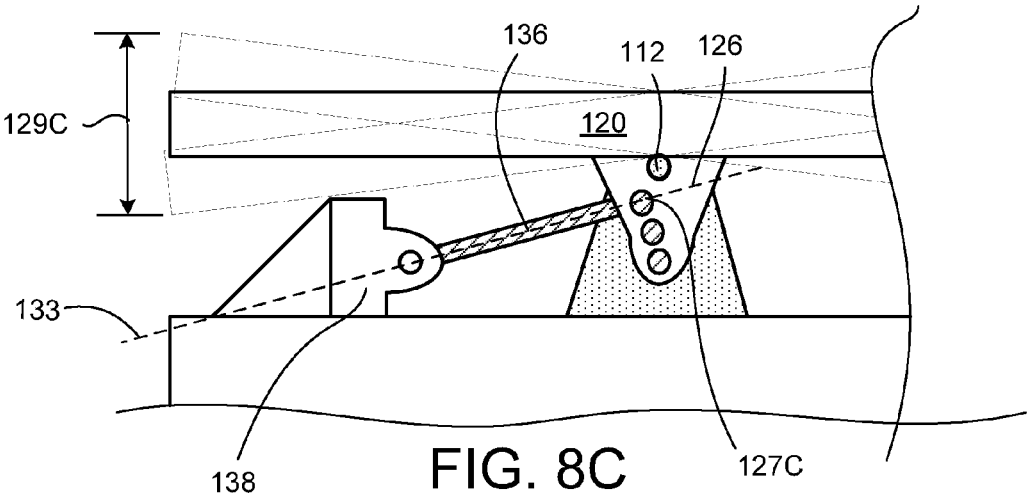
FIG. 8C is a schematic front view of another embodiment of a vibrating platform apparatus in a third oscillation magnitude configuration.

FIGS. 8A-C are schematic front views of three embodiments of a vibrating platform module 100 in three different oscillation magnitude configurations. As described above, the displacement member 136 may extend in a substantially horizontal displacement direction 133 that is substantially perpendicular to the vertical direction 125 of the lateral portions 124 of the platform 120. The oscillation magnitude 129A-C of the platform 120 is dependent on where the displacement member 136 connects to the arm 126. For example, the oscillation magnitude 129 caused by the linear reciprocating motion of the displacement member 136 in the horizontal displacement direction 133 increases as the distance between the platform 120 and the connection point 127 of the arm 126 decreases. In other words, the configuration depicted in FIG. 8A has an oscillation magnitude 129A that is comparatively smaller than the oscillation magnitude 129B of FIG. 8B because the displacement member 136 in FIG. 8A is attached to a connection point 127A that is further removed from the platform 120 than the connection point 127B of FIG. 8B. In turn, the oscillation magnitude 129B of FIG. 8B is comparatively smaller than the oscillation magnitude 129C of FIG. 8C because the displacement member 136 in FIG. 8B is attached to a connection point 127B that is further removed from the platform 120 than the connection point 127C of FIG. 8C.

Accordingly, the change of the oscillation magnitude 129 is controlled, in part, by the distance between the platform 120 and the connection point 127 of the arm 126. In one embodiment, the arm 126 may have multiple connection points 127, thus allowing a user to selectively configure the vibrating platform module 100 according to his/her preferred oscillation magnitude. Further, the vibrating platform module 100 may include replaceable or telescoping displacement members 136 that facilitate the various configurations.

In another embodiment, conveying and converting rotational energy from the motor 132 to a reciprocating, oscillating force on the platform 120 includes other components not previously described. For example, the power assembly 130 may include intermediate belts, chains, shafts, or gears, among others, to actuate the oscillation of the platform 120. In one embodiment, a cam assembly or other oscillation inducing assembly may be operably inter-coupled between the motor 132 and the platform 120. As described above, these power assembly components may be positioned and oriented to minimize the height of the vibrating platform module 100. For example, a motor 132 may drive a horizontal displacement member 136, a belt, a chain, etc. connected to a cam assembly that converts horizontal movement to vertical movement. The cam assembly may connect to the platform 120, for example at a location away from the fulcrum. The cam assembly may be positioned such that the overall height of the platform 120 is lower than other embodiments described herein.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for vibration of a person via a vibrating platform, the apparatus comprising:

a support structure comprising a fulcrum and a plurality of vibration isolators;

a platform comprising:

a central portion and lateral portions, wherein the central portion of the platform is pivotally coupled to and operably oscillates about the fulcrum of the support structure, wherein oscillation about the fulcrum causes the lateral portions to alternately rise and fall in a substantially vertical direction, and an arm that extends below the central portion;

a power assembly comprising a displacement member, wherein the power assembly is coupleable to the platform via the displacement member to operably oscillate the platform about the fulcrum; and a base shell extending around sides of the platform, wherein the base shell is mounted to the support structure free from connectors other than the vibration isolators, wherein:

the arm comprises multiple connection points along a length of the arm to which the displacement member can be selectively coupled, and an oscillation magnitude of the platform about the fulcrum is dependent on which connection point the displacement member is selectively coupled to.

2. The apparatus of claim 1, wherein the vibration isolators comprise first vibration isolators and the apparatus further comprises second vibration isolators positioned between the support structure and a surface supporting the apparatus that isolate vibrations from the support structure to the surface supporting the apparatus.

3. The apparatus of claim 2, wherein the second vibration isolators support the support structure above the surface supporting the apparatus in addition to providing vibration isolation.

4. The apparatus of claim 1, further comprising a riser coupled to the base shell, the riser comprising handles, the handles located at a height convenient for a user to hold while the user is positioned on the platform during vibration.

5. The apparatus of claim 4, wherein one or more of the base shell and the riser contact a surface supporting the apparatus at one or more surface contact points, wherein the surface contact points further stabilize the base shell and the riser from vibrations of the platform and the support structure.

6. The apparatus of claim 1, wherein the vibration isolators comprise motion dampers.

7. The apparatus of claim 1, wherein the base shell is mounted to the support structure exclusively via the vibration isolators.

8. The apparatus of claim 1, wherein the displacement member extends in a displacement direction and the displacement direction is substantially perpendicular to the vertical direction.

9. The apparatus of claim 1, wherein the power assembly further comprises:

a motor mounted to the support structure;

a driveshaft rotated by the motor, wherein the driveshaft extends in a first direction, wherein the displacement member is rotatably and eccentrically coupled to the driveshaft and wherein the first direction is substantially perpendicular to the displacement direction; and two bearings mounted to the support structure for supporting the driveshaft, wherein the two bearings are positioned on opposite sides of the displacement member.

10. The apparatus of claim 9, wherein the displacement member and at least one of the two bearings are mounted to the support structure in a position beyond a horizontal footprint of the platform.

11. An apparatus for vibration of a person via a vibrating platform, the apparatus comprising:

a support structure comprising a fulcrum and a plurality of vibration isolators including a rubber material;

a platform comprising a central portion and lateral portions, wherein the central portion of the platform is pivotally coupled to and operably oscillates about the fulcrum of the support structure, wherein oscillation about the fulcrum causes the lateral portions to alternately rise and fall in a substantially vertical direction;

a power assembly comprising:

a motor mounted to the support structure, a driveshaft rotated by the motor, wherein the driveshaft extends in a first direction, a displacement member rotatably and eccentrically coupled to the driveshaft and extending in a displacement direction, wherein the first direction is substantially perpendicular to the displacement direction, and two bearings mounted to the support structure for supporting the driveshaft; and a base shell extending around sides of the platform, wherein the base shell is mounted to the support structure free from connectors other than the vibration isolators, wherein the driveshaft comprises an eccentric section to which the displacement member is rotatably coupled.

12. The apparatus of claim 11, wherein the vibration isolators comprise first vibration isolators and the apparatus further comprises second vibration isolators positioned between the support structure and a surface supporting the apparatus that isolate vibrations from the support structure to the surface supporting the apparatus.

13. The apparatus of claim 11, wherein the vibration isolators comprise motion dampers.

14. The apparatus of claim 11, wherein the base shell is mounted to the support structure exclusively via the vibration isolators.

15. The apparatus of claim 11, wherein the two bearings are positioned on opposite sides of the displacement member.

16. The apparatus of claim 15, wherein the two bearings are equally spaced from the displacement member.

17. An apparatus for vibration of a person via a vibrating platform, the apparatus comprising:

a support structure comprising a fulcrum and a plurality of vibration isolators;

a platform comprising a central portion and lateral portions, wherein the central portion of the platform is pivotally coupled to and operably oscillates about the fulcrum of the support structure, wherein oscillation about the fulcrum causes the lateral portions to alternately rise and fall in a substantially vertical direction;

a power assembly comprising:

a motor mounted to the support structure, a driveshaft rotated by the motor, wherein the driveshaft extends in a first direction, a displacement member rotatably and eccentrically coupled to the driveshaft and extending in a displacement direction, wherein the first direction is substantially perpendicular to the displacement direction, and two bearings mounted to the support structure for supporting the driveshaft, wherein the two bearings are positioned on opposite sides of the displacement member; and a base shell extending around sides of the platform, wherein the base shell is mounted to the support structure free from connectors other than the vibration isolators.

18. The apparatus of claim 17, wherein the two bearings are equally spaced from the displacement member.

19. The apparatus of claim 17, wherein the driveshaft comprises an eccentric section to which the displacement member is rotatably coupled.

* * * * *